US008572816B2

(12) United States Patent
Dono et al.

(10) Patent No.: US 8,572,816 B2
(45) Date of Patent: Nov. 5, 2013

(54) SLIDE FASTENER

(75) Inventors: Kenji Dono, Toyama (JP); Shunji Akashi, Toyama (JP); Hiroshi Ishisaka, Toyama (JP); Naoyuki Himi, Toyama (JP)

(73) Assignee: YKK Corporation (JP)

( * ) Notice: Subject to any disclaimer, the term of this patent is extended or adjusted under 35 U.S.C. 154(b) by 245 days.

(21) Appl. No.: 12/811,603

(22) PCT Filed: Dec. 11, 2008

(86) PCT No.: PCT/JP2008/072505

§ 371 (c)(1),
(2), (4) Date: Sep. 7, 2010

(87) PCT Pub. No.: WO2009/087851

PCT Pub. Date: Jul. 16, 2009

(65) Prior Publication Data

US 2011/0041296 A1 Feb. 24, 2011

(30) Foreign Application Priority Data

Jan. 8, 2008 (JP) ..... 2008-001491

(51) Int. Cl.
*A44B 19/08* (2006.01)
*A44B 19/04* (2006.01)

(52) U.S. Cl.
USPC ..... 24/413; 24/403; 24/405; 24/409; 24/704.1

(58) Field of Classification Search
USPC ..... 24/409, 410, 411, 412, 413, 403, 404, 24/391, 394, 396, 704.1, 405
See application file for complete search history.

(56) References Cited

U.S. PATENT DOCUMENTS

| | | | | | |
|---|---|---|---|---|---|
| 1,658,392 | A | * | 2/1928 | Prentice et al. | 24/411 |
| 2,060,830 | A | * | 11/1936 | Silberman | 24/413 |
| 3,337,928 | A | * | 8/1967 | Glindemeyer | 24/394 |
| 3,359,604 | A | * | 12/1967 | Glindmeyer | 24/396 |
| 3,667,089 | A | * | 6/1972 | Porepp | 24/391 |
| 3,768,125 | A | * | 10/1973 | Frohlich | 24/396 |
| 3,783,476 | A | * | 1/1974 | Frohlich | 24/394 |
| 3,789,465 | A | * | 2/1974 | Moertel | 24/395 |
| 3,820,202 | A | | 6/1974 | Takamatsu | |
| 3,825,978 | A | * | 7/1974 | Sakalys | 24/410 |
| 3,874,038 | A | * | 4/1975 | Takamatsu | 24/413 |
| 3,946,465 | A | * | 3/1976 | Moertel | 24/394 |
| 4,034,444 | A | * | 7/1977 | Moertel | 24/394 |
| 4,060,886 | A | * | 12/1977 | Moertel | 29/410 |
| 4,078,278 | A | * | 3/1978 | MacFee | 24/412 |
| 4,495,679 | A | * | 1/1985 | Scarpini | 24/414 |

(Continued)

FOREIGN PATENT DOCUMENTS

| | | |
|---|---|---|
| JP | 02-177902 | 7/1990 |
| JP | 2004-298641 | 10/2004 |
| JP | 2006-015158 | 1/2006 |

*Primary Examiner* — Robert J Sandy
*Assistant Examiner* — Abigail E Morrell
(74) *Attorney, Agent, or Firm* — Kilpatrick Townsend & Stockton LLP

(57) ABSTRACT

A slide fastener in which a fastener element has first and second leg portions continuously disposed at both ends of the coupling head is folded in half at its center, and the first leg portion is attached to a coupling element attaching portion of a fastener tape by a sewing thread. A vulnerable portion which is cut out into a V is formed on the bent end face of the coupling head.

4 Claims, 10 Drawing Sheets

(56) References Cited

U.S. PATENT DOCUMENTS

| | | | | | |
|---|---|---|---|---|---|
| 4,639,981 | A * | 2/1987 | Yoshida et al. | 24/401 |
| 4,989,300 | A * | 2/1991 | Fukuroi | 24/391 |
| 5,058,246 | A * | 10/1991 | Fujisaki et al. | 24/394 |
| 5,142,747 | A * | 9/1992 | Matsushima | 24/391 |
| 5,167,051 | A * | 12/1992 | Kousaka | 24/391 |
| 5,511,292 | A * | 4/1996 | Covi et al. | 24/410 |
| 5,528,801 | A * | 6/1996 | Hasegawa | 24/403 |
| 6,092,267 | A * | 7/2000 | Covi et al. | 24/410 |
| 7,337,506 | B2 * | 3/2008 | Kusayama et al. | 24/389 |
| 7,353,570 | B2 * | 4/2008 | Himi | 24/405 |
| 7,416,397 | B2 * | 8/2008 | Kusayama et al. | 425/116 |
| 2006/0000065 | A1 * | 1/2006 | Takasawa et al. | 24/401 |

* cited by examiner

SLIDE FASTENER

TECHNICAL FIELD

The present invention relates to a slide fastener which has a predetermined resistance to a lateral pulling force and is cleaved when a lateral pulling force larger than a cleavage lateral pulling force is applied, and particularly, to a slide fastener for use in an airbag expansion opening which allows the airbag to expand when an automobile collides.

BACKGROUND ART

In recent years, a seat back side portion or a roof compartment portion above a door of a vehicle is provided with a side airbag for protecting the head of passengers when the vehicle collides. The side airbag unit includes an inflator for generating expansion gas after a large impact is received due to the vehicle collisions and an airbag which is supplied with gas from the inflator and expanded. As for the storage state of the airbag before the side airbag unit is actuated, the airbag is stored in the seat back side portion of a vehicle seat such that the airbag is folded in a predetermined procedure and the side airbag unit is covered with a seat cover or the like.

Usually, the surface of the vehicle seat is covered with a seat cover made of fabric or leather in order to cover the cushion material of the seat, and the seat cover on the seat back side portion equipped with a side airbag unit has an opening for expansion through which the airbag is to be inflated. Conventionally, the expansion opening is sewed together with a weak sewing thread which is cut out easily when it is pulled with a predetermined force.

When a vehicle collides so that a large impact is received, the side airbag unit senses the impact and generates a high pressure gas from its inflator and introduces the high pressure gas into the airbag, so that the airbag is inflated in a moment. When the airbag is expanded, an excessive pulling force is applied to the sewing thread which sews together the expansion opening and consequently, the sewing thread is cut out by the force. Then, the closed expansion opening is opened and then the airbag comes out expanded from the opening. The airbag is expanded sideway of a passenger so as to support the head, chest and waist of the passenger by absorbing the shock. Consequently, the impact applied to the human body at the time of a collision is relaxed largely so as to secure the safety of the passenger.

If a configuration which closes the airbag expansion opening with the sewing thread is adopted, the seat cover needs to be placed after the airbag unit is loaded onto the seat. Consequently, manufacturing process is limited, which is an inconvenient problem. Because recent vehicle seats are equipped with various auxiliary devices such as a heater, seat level adjusting actuator in many cases, the freedom on the manufacturing process has been demanded. Further, if the airbag unit needs to be inspected after a vehicle is delivered to a customer, conventionally, the airbag unit cannot be inspected until the seat cover is removed, thereby complicating the working process.

Additionally, a breaking resistance of the sewing thread is changed largely depending on its sewed state and further changed depending on rises in temperature of a vehicle compartment or aging, which is another inconvenience. If the sewing thread is not cut out easily, the airbag may not be expanded at an emergency, which is a fatal inconvenience. If the strength of the sewing thread is low, the sewing thread is broken by a pulling force applied to the seat cover when a passenger is seated, so that the expansion opening is cleaved and the seat cushion is exposed, which damages the appearance.

When the airbag is expanded, the sewing thread is cut out one by one, so that the expansion speed of the airbag is lowered, which is still another inconvenience.

Instead of the configuration which closes the expansion opening using the sewing thread containing such various inconveniences, the closing configuration for the expansion opening using the slide fastener has attracted public attentions. The slide fastener can open and close the expansion opening by moving the slider up and down even after the seat cover is attached. Therefore, the freedom of the assembly process is intensified, so as to enable a complicated configuration seat to be assembled easily. Additionally, at the time of inspection of the airbag unit, wiring and installation portions can be inspected easily by opening and closing the slide fastener.

If coupling of coupling elements is released on part of the slide fastener in which the coupling elements are coupled with one another and a lateral pulling force is continued to be applied under this state, the coupling of the coupling elements can be released successively with a weak force without moving the slider. Therefore, different from a state in which the sewing thread is broken one by one, the cleavage velocity is higher so that the airbag can be expanded quickly so as to protect a passenger. Particularly, because a gap between the head of the passenger and the side glass of a vehicle is small, the side airbag needs to be inflated in a short time after a collision.

For example, Patent Document 1 (Japanese Patent Application Laid-Open Publication No. 2006-15158) has disclosed a slide fastener with an emergency opening means having a configuration which can be cleaved easily in order to inflate and expand the airbag.

The slide fastener with the emergency opening means described in Patent Document 1 uses insert molding method of fixing the coupling elements to the coupling element attaching portion of the fastener tape at the same time when the coupling elements are molded. The configuration of the coupling element of the slide fastener includes two leg portions which are fixed to the coupling element attaching portion on the fastener tape side edge portion such that the leg portions sandwich the coupling element attaching portion, a body portion which connects the two leg portions, a coupling head formed on the outer end portion for coupling a pair of the coupling elements, right and left in a lateral pulling direction and a neck portion which is twisted to connect the coupling head with the body portion. A groove is formed in the apex of the coupling head along the coupling axis line. Further, a shoulder portion intended to be fitted to the groove is formed in the central portion in the width direction of the coupling element such that the shoulder portion is projected from the body portion and the neck portion.

The coupling head is fitted in between the neck portions of the two adjacent coupling elements fixed to the opposite other side fastener tape in order to prevent coupled coupling element rows from being cleaved in the lateral pulling direction. The shoulder portion projecting from the neck portion and body portion of the coupling element is fitted to the groove portion provided in the opposite coupling head, so as to prevent the right and left fastener stringers from being deviated in a shearing direction and decoupled from one another.

In the slide fastener described in Patent Document 1, the rear side of the coupling head which is to be fitted to the shoulder portion of the coupling element is cut out so as to obtain a nose-like shape asymmetrical between the front and rear sides and two pieces of the coupling element are disposed in the central portion of the slide fastener. The portion is cleaved easily by a pushing force from the rear side of the slide fastener and becomes a cleavage starting point in the slide fastener when the airbag is inflated.

Patent Document 2 (Japanese Patent Application Laid-Open Publication No. 10-155524) has disclosed a slide fastener in which coupling elements are disposed at a constant interval in the shape of a rope ladder by molding two connecting threads at the same time. In the slide fastener descried in Patent Document 2, the connected coupling element rows are bent into a U shape so as to sandwich the coupling element attaching portion on the side edge portion of the fastener tape. After that, the coupling element rows are sewed to the fastener tape by placing the sewing thread such that the sewing thread strides around the leg portions of the coupling elements, so that the coupling head of the coupling element is projected outward from the coupling element attaching portion on the side edge portion of the fastener tape.

Patent Document 1: Japanese Patent Application Laid-Open Publication No. 2006-15158

Patent document 2: Japanese Patent Application Laid-Open Publication No. 10-155524

DISCLOSURE OF THE INVENTION

Problems to be Solved by the Invention

In the slide fastener with an emergency opening means described in Patent document 1, the cleavage starting point is formed in the central portion of the slide fastener in order to make the coupling elements in an decoupling from each other easily when a force is applied from the rear side due to the inflation of the airbag. When the airbag is inflated, first, the coupling of the coupling elements is released at the cleavage starting point having the coupling heads asymmetrical between the front and rear sides and accompanied by the expansion of the airbag, the coupling of the coupling elements is released successively toward end portions of the slide fastener.

Although the slide fastener has various advantages for closing the expansion opening of the airbag, the configuration of the coupling element described in Patent Document 1 has a possibility that a breaking occurs in the neck portion of the coupling element or a thin portion of the leg portion when an excessive lateral pulling force is applied for some reason, so that the coupling head of the coupling element may be separated from the fastener tape.

The slide fastener described in Patent document 1 is a slide fastener in which the coupling elements can be seen directly from the front side. Thus, if the slide fastener is used for closing the expansion opening in the vehicle seat cover, a covering such as a flap needs to be attached to the front side of the slide fastener. If the covering is attached to the front side of the slide fastener, it is seen evidently that any slide fastener exists there, thereby causing an inconvenience that a joint of fabrics is seen on the appearance.

The coupling element of the slide fastener described in Patent document 2 has two leg portions which are forked from the coupling head, and the two leg portions are formed in a symmetrical shape across the coupling head. As a result, when an excessive lateral pulling force is applied at the time of airbag expansion, the two leg portions can be broken all at once so that the coupling head of the coupling element may be separated from the fastener tape. Because the slide fastener can be seen directly from the front side like the slide fastener described in Patent Document 1, an inconvenience of a bad appearance is produced if it is applied to the vehicle seat cover.

The present invention has been achieved in views of the above-described conventional problems and an object of the invention is to provide a slide fastener in which a broken part of a coupling element is not separated easily at the time of a forced cleavage, for example, when the airbag is inflated. Another object of the present invention is to provide a slide fastener having an intensified concealing performance in order to make the coupling elements of the slide fastener invisible from outside.

To achieve the above-described object, the present invention provides a slide fastener in which a sewing line is formed by sewing first and second leg portions of a coupling element using sewing threads at plural positions along a tape length direction of the coupling element attaching portion of each of a pair of the right and left fastener tapes, the first and second leg portions being forked and extended from a coupling head, the slide fastener comprising a vulnerable portion whose breaking resistance is weakened, at least at a single position of the first and second leg portions in the range from the sewing line of the first leg portion up to the sewing line of the second leg portion via the coupling head.

Preferably, the vulnerable portion is formed in the coupling head. The vulnerable portion may be formed at a single position in the range from the sewing line up to the coupling head.

Preferably, the coupling elements adjacent at the end portions of the first and second leg portions are connected with the connecting thread. Further, the plurality of coupling elements can be coil-like or zigzag-like coupling elements in which the end portions of the first and second leg portions are connected via each reversal connecting portion.

Effect of the Invention

In the slide fastener of the present invention, the vulnerable portion having the weakened breaking resistance is formed at a single position in the range from the sewing line on the first leg portion of the coupling element up to the sewing line of the second leg portion via the coupling head. Consequently, even if an excessive lateral pulling force is applied to the slide fastener because of some influences, so that the coupling element is broken, breaking occurs at only the vulnerable portion having the weak breaking resistance. Because both sides of the vulnerable portion are sewed to the fastener tape with the sewing thread, an inconvenience that a broken part of the broken coupling element is separated can be reduced.

Further, by connecting a plurality of adjacent coupling elements to one another through the first and second leg portions using the connecting thread, even if an excessive lateral force is applied to the slide fastener so that both a single position of the connecting thread and the sewing thread are broken, the inconvenience that the broken part of the broken coupling element is separated can be reduced.

By using the coil-like or zigzag-like continuous coupling element as the coupling element rows, even if an excessive lateral force is applied to the slide fastener so that both a single position of the coupling element and the sewing thread are broken, the inconvenience that the broken part of the broken coupling element is separated can be reduced.

EXPLANATIONS OF REFERENCE NUMERALS

Figure 1:
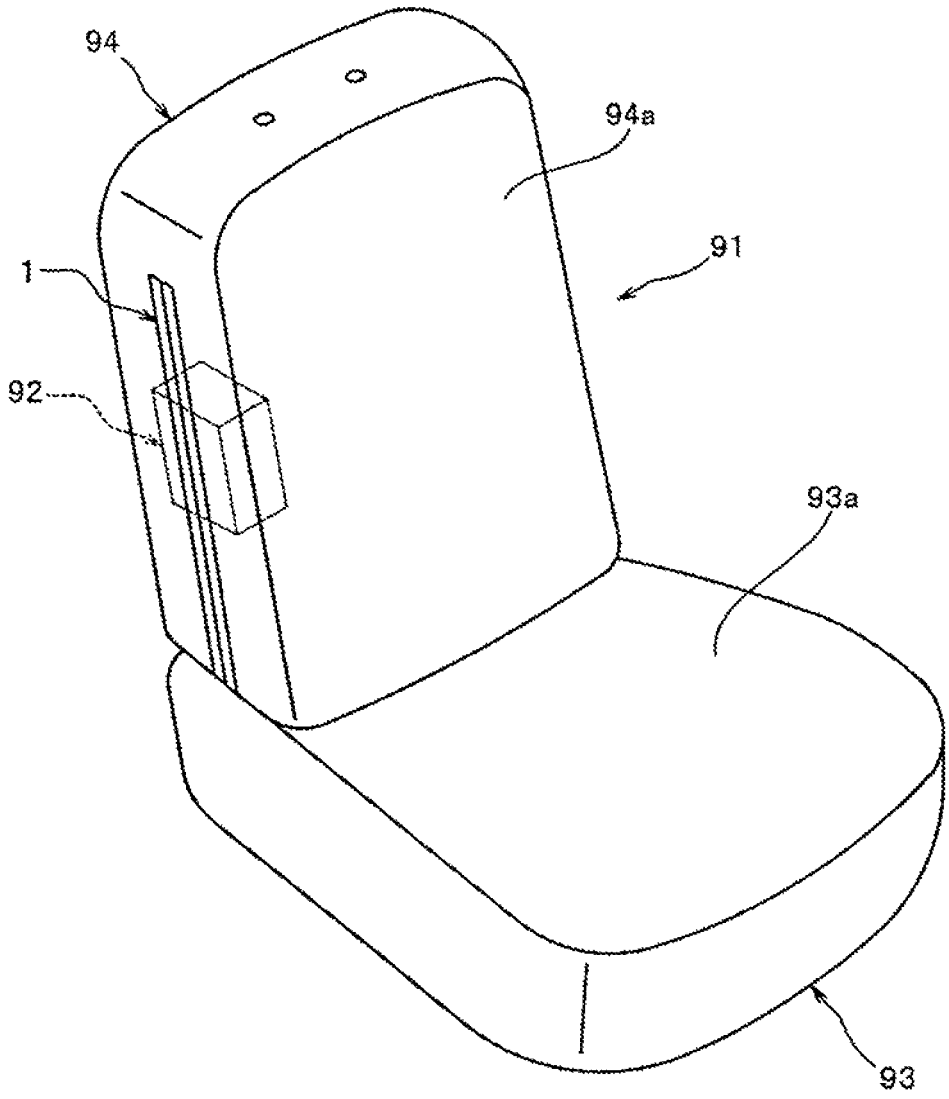
FIG. 1 is a view showing an example of using a slide fastener according to the present invention to a seat bag side portion of a vehicle seat.

1, 110: slide fastener
12, 112: left coupling element
12*a*: left coupling element row
13, 113: right coupling element
13*a*: right coupling element row
14: core thread
15: sewing thread
16, 616: left fastener tape
17: right fastener tape
50: slider
70, 470, 670: coupling head
72, 472, 672, 572: first leg portion
73, 473, 673, 573: second leg portion
74, 75, 574, 575, 674, 675: sewing portion
76: connecting thread
80: vulnerable portion
82: opening
84, 85, 86: sewing line
212, 312, 412, 512, 612: coupling element
576, 676: reversal connecting portion
516: fastener tape
C: coupling element width
D: neck width
H: mountain height

BEST MODE FOR CARRYING OUT THE INVENTION

Hereinafter, a typical embodiment of a coupling element and a slide fastener using the coupling element according to the present invention will be described specifically with reference to the accompanying drawings.

FIG. 1 is a view showing an example of using a slide fastener according to the present invention to a seat bag side portion of a vehicle seat.

For example, the slide fastener according to the present invention can be used for a seat cover opening of a vehicle seat 91 incorporating a side airbag unit 92 internally. The vehicle seat 91 shown in FIG. 1 includes a seat cushion 93 which forms a seat portion and a seat back 94 which forms a backrest portion. The seat cushion 93 and the seat back 94 contain a seat frame which forms the entire shape of the vehicle seat 91, a seat spring which receives a pressure while averaging a load when a passenger is seated on the vehicle seat 91, and a cushion member formed of foamed synthetic resin into a predetermined shape. The surface of the cushion member is covered with seat covers 93*a*, 94*a* made of fabric or leather.

The side portion of the seat back 94 contains the side airbag unit 92 which is expanded sideway of a passenger when a large impact is received at the time of a vehicle collision so as to relax the impact applied to the side of the head of the passenger largely. The expansion opening of the side airbag unit 92 is closed by the aforementioned slide fastener 1. In the meantime, the inside of the vehicle seat 91 contains an actuator for seat level adjustment, its actuating mechanism, a heater for heating the seat surface and other auxiliary devices as well as the side airbag unit 92.

The seat cover 94*a* is placed on the backrest portion after the side airbag unit 92 and other auxiliary devices are assembled and then closed with the slide fastener 1 by sliding the slider of the slide fastener 1. By using a concealed type slide fastener in which coupling element rows are arranged on the rear side of the slide fastener 1, the appearance of the side portion of the seat back 94 can be improved in terms of the beauty. Unless the concealed type slide fastener is used, the coupling element rows can be concealed from outside by disposing flaps on the surface of the slide fastener 1.

When a passenger is seated on the vehicle seat 91, the central portion of the backrest of the seat back 94 is dented due to the load of the passenger, so that the lateral pulling force is applied to the slide fastener 1 which covers the side portion of the seat back 94. The slide fastener 1 needs to have a capacity of withstanding the lateral pulling force applied at the time of usual usage. On the other hand, when the vehicle collides, it is necessary to cleave the slide fastener 1 so that the airbag is expanded. Thus, the slide fastener 1 needs to withstand the lateral pulling force of about 10 N/cm applied usually sufficiently and when a lateral pulling force of 150 to 350 N/cm is applied by the expansion of the airbag, cleaved within 20/1000 seconds so as to inflate the airbag.

This request is satisfied by providing the slide fastener with a cleavage starting point in which the shape of the coupling head is formed asymmetrically in terms of its front side and rear side as described in Patent Document 1. Consequently, when the airbag is expanded, first, the coupling is released at the cleavage starting point and accompanied by the expansion of the airbag, the elements are decoupled successively toward the end portion of the slide fastener, thereby satisfying such contradicting requests.

If the coupling is released at part of the slide fastener 1 when the airbag is expanded, the couplings of the coupling element rows are released successively toward the end portion of the slide fastener accompanied by the expansion of the airbag. The airbag is expanded out of the cleavage portion of the slide fastener 1 so as to substantially relax the impact force applied to the human body at the time of a vehicle collision, thereby securing the safety of the passenger. However, at the time of a forced cleavage when the airbag is expanded, there is a possibility that part of the coupling element may be broken by a strong lateral pulling force applied to the coupling head of the slide fastener 1.

Accordingly, the slide fastener 1 according to the present invention uses the coupling element having a first leg portion and a second leg portion which are forked from the coupling head, and a vulnerable portion having the weakened breaking resistance is formed at a single position in a range from a sewing line of a first sewing portion on the first leg portion up to a sewing line of a second sewing portion on the second leg portion via the coupling head. The configuration of the coupling element will be described with reference to FIG. 2.

First Embodiment

Figure 2:
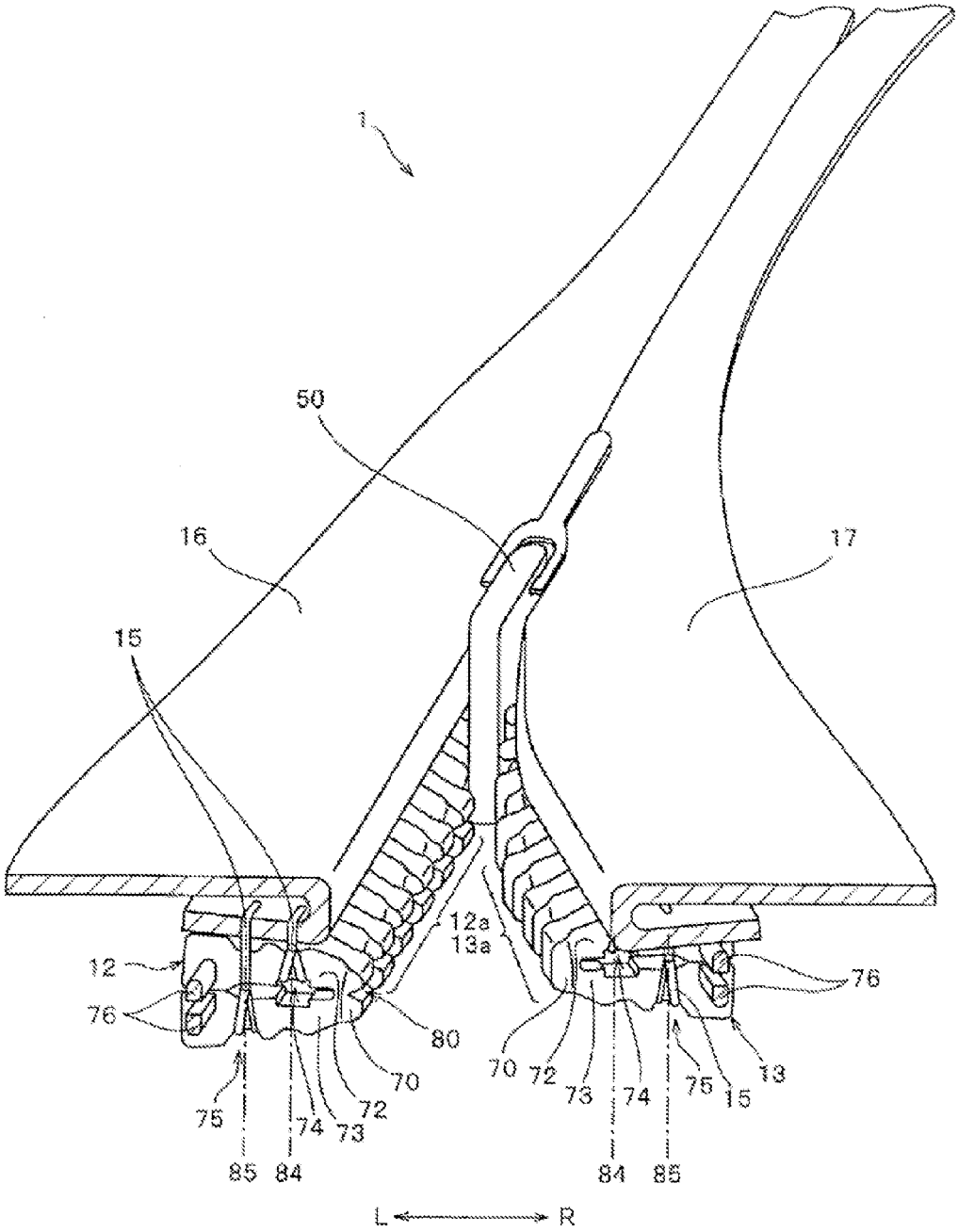
FIG. 2 is an appearance view of the slide fastener according to the present invention, showing a section at right angle to a coupling axis of the slide fastener.
Figure 3:
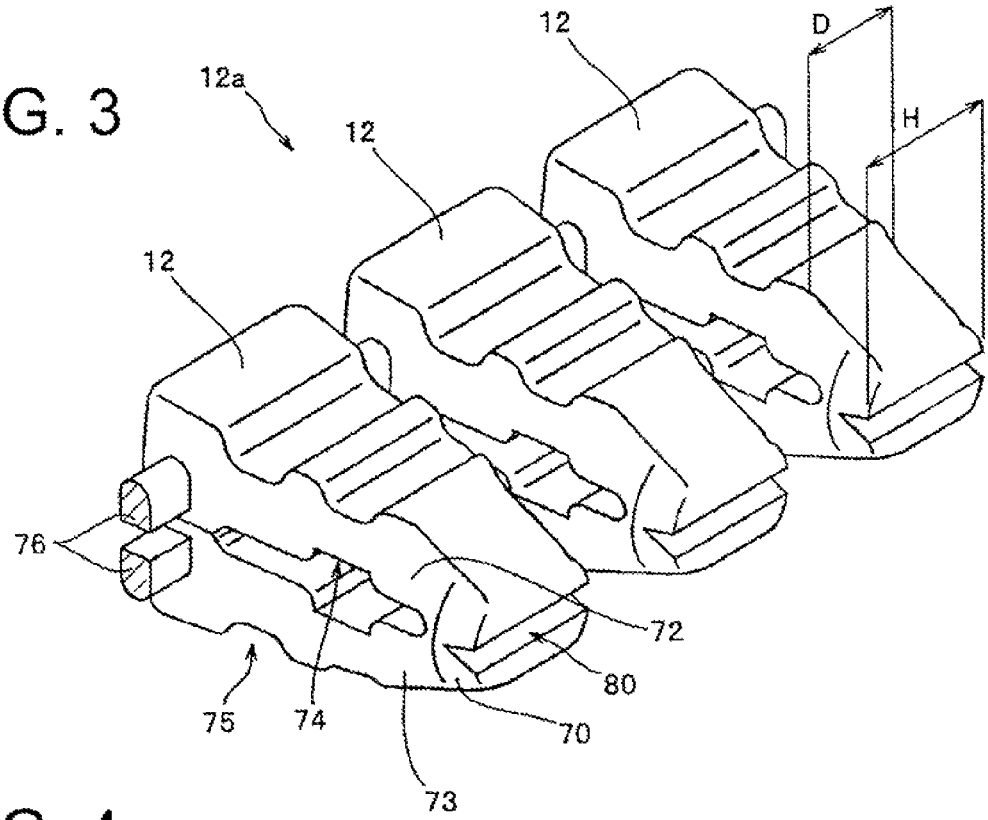
FIG. 3 is an enlarged view of a left coupling element row of the slide fastener shown in FIG. 2.

FIG. 2 is an appearance view of a slide fastener 1 according to the present invention and shows a section at right angle to a coupling axis of the slide fastener 1 in order to explain the shape of the coupling element. FIG. 3 is a view for explaining only a left coupling element row 12*a* of the slide fastener 1 shown in FIG. 2 in enlargement.

As shown in FIGS. 2 and 3, the slide fastener 1 includes a left fastener tape 16, a right fastener tape 17, a left coupling element row 12*a* and right coupling element row 13*a* disposed along opposite coupling element attaching portions of the left fastener tape 16 and the right fastener tape 17, and a slider 50 which couples or decouples the left coupling element row 12*a* and the right coupling element row 13*a* when it is moved vertically with the left coupling element row 12*a* and the right coupling element row 13*a* passed through the slider 50.

The coupling element attaching portion of the slide fastener 1 shown in FIG. 2 is formed to be reverted in a U shape toward its rear side and the left coupling element row 12*a* and the right coupling element row 13*a* are sewed to the coupling element attaching portions of the left fastener tape 16 and the right fastener tape 17, reverted in the U shape with a sewing thread 15. In the meantime, although the slide fastener 1 shown in FIG. 2 is a concealing type slide fastener having concealing performance, the present invention is not limited to the concealing type slide fastener but may be applied to the slide fastener shown in FIGS. 13 and 15, which will be described later. Further, although the left coupling element row 12*a* and the right coupling element row 13*a* of the slide fastener 1 shown in FIG. 2 are coupling element rows formed by injection molding, the present invention is not limited to the coupling element formed by injection molding but a zigzag-like monofilament coupling element row (see FIG. 14 described later) or coil-like monofilament coupling element row (see FIG. 15 described later) may be used.

As shown in FIG. 2, the left coupling element 12 and right coupling element 13 which constitute the left coupling element row 12*a* and the right coupling element row 13*a* have a coupling head 70 for coupling the right and left coupling elements, and a first leg portion 72 and a second leg portion 73 which are forked from the coupling head 70 in front-rear side direction. A cut-out like vulnerable portion 80 is formed in the center of the coupling head 70 of the left coupling element 12 by reducing the sectional area of the coupling head 70. The vulnerable portion 80 may be formed in only the coupling head 70 of any one of the left coupling element 12 and the right coupling element 13 or may be formed on both the coupling heads 70 of the left coupling element 12 and the right coupling element 13. Although the vulnerable portion 80 in the embodiment shown in FIG. 2 is cut out into a V shape from outside of the coupling head 70, it may be formed by cutting out from the inside of the coupling head 70.

In a portion on the side of the second leg portion 73 at a portion between the end portion of the first leg portion 72 extending from the coupling head 70 and the coupling head 70, a sewing portion 74 (concave groove) which the sewing'thread 15 for sewing the coupling elements to a left fastener tape 16 or the right fastener tape 17 strides around is formed preliminarily. Further, a sewing portion 75 (concave groove) which the sewing thread 15 strides around is formed preliminarily in a portion on the outer peripheral side at a portion between the end portion of the second leg portion 73 and the coupling head 70. The sewing portion 74 and the sewing portion 75 are not limited to the concave grooves formed preliminarily in the first leg portion 72 and the second leg portion 73. For example, the present invention includes a sewing portion which is formed when the leg portion is distorted by sewing after the coupling element is sewed with the sewing thread 15, like the continuous coupling element made of synthetic resin monofilament.

As shown in FIG. 2, a straight line at right angle to the left fastener tape 16 at the portion which the sewing thread 15 strides around in the sewing portion 74 of the first leg portion 72 is defined as a sewing line 84. Further, a straight line at right angle to the left fastener tape 16 at the portion which the sewing thread 15 strides around at the sewing portion 75 of the second leg portion 73 is defined as a sewing line 85. The vulnerable portion 80 having the weakened breaking resistance is formed at a single position in the range from the sewing lien 84 of the first leg portion 72 up to the sewing line 85 of the second leg portion 73 via the coupling head 70.

A connecting thread 76 is passed through the end portions (proximal portion) of the first leg portion 72 and the second leg portion 73 in order to connect the left coupling elements 12 and the right coupling elements 13 at a uniform interval to form the left coupling element row 12*a* and the right coupling element row 13*a*. The connecting thread 76 is integrated with molding by insert molding as shown in FIG. 4 when the left coupling element row 12*a* and the right coupling element row 13*a* are molded.

Figure 4:
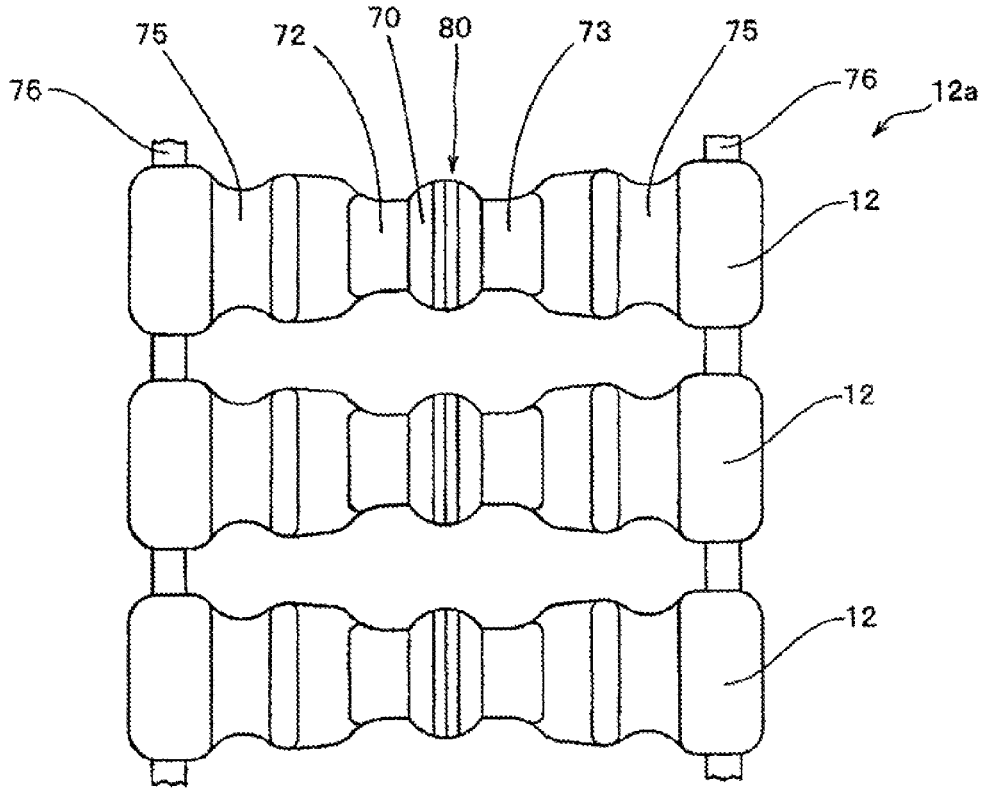
FIG. 4 is a plan view showing a state of the left coupling elements just after molding.

FIG. 4 is a plan view showing a state of the left coupling element row 12*a* just after molding.

As shown in FIG. 4, the left coupling element row 12*a* just after molding is molded on a straight line such that the first leg portion 72, the coupling head 70 and the second leg portion 73 are symmetrical to one another. The end portions of the first leg portion 72 and the second leg portion 73 are connected with the connecting threads 76 so as to keep a predetermined gap necessary for coupling the right coupling element row 13*a* between the respective left coupling elements 12. In the meantime, the vulnerable portion 80 is formed in the central portion of the coupling head 70 by cutting out into a V shape along the coupling axis.

Figure 5:
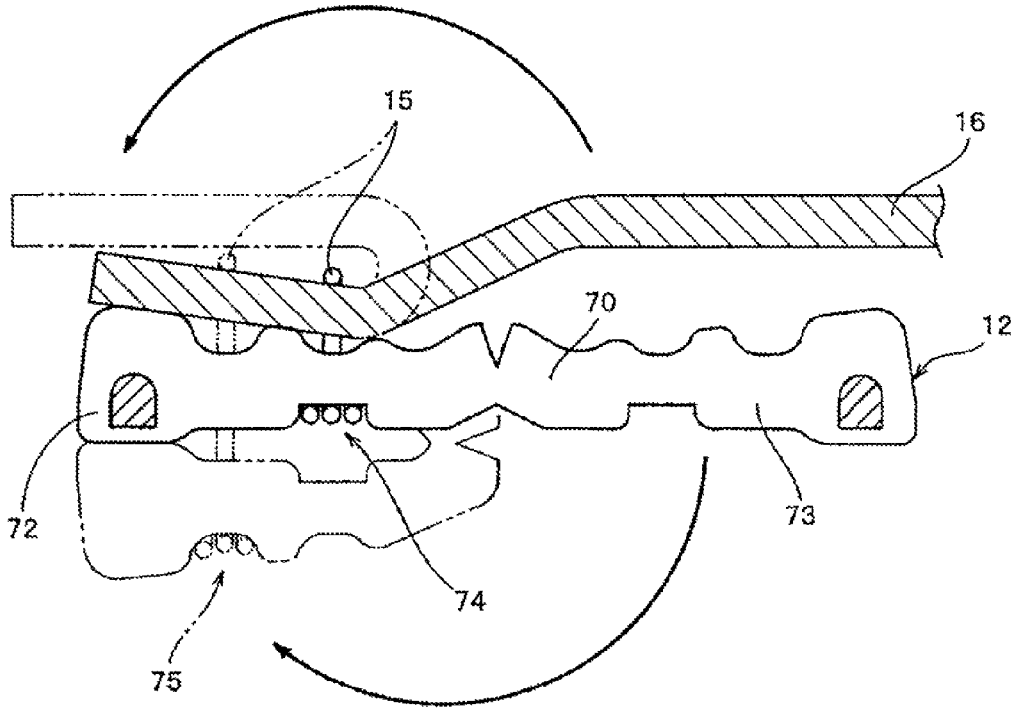
FIG. 5 is a diagram showing a process of sewing the molded left coupling element rows onto a left fastener tape.

FIG. 5 shows a state in which the molded left coupling element row 12*a* is sewed to the left fastener tape 16.

The molded left coupling element row 12*a* shown in FIG. 4 is disposed on a coupling element attaching portion of the left fastener tape 16 and sewed by placing the sewing thread 15 such that it strides across the sewing portion 74 of the first leg portion 72. After that, the second leg portion 73 is rotated in a clockwise direction around the central portion of the coupling head 70 from a state shown in FIG. 5 and overlaid on the first leg portion 72 from below.

Next, both end portions of the left coupling element row 12*a* are treated by sewing to the left fastener tape 16 with the sewing thread 15 striding across the sewing portion 75. Finally, the coupling element attaching portion of the left fastener tape 16 is rotated in a counterclockwise direction into a U shape so that the coupling head 70 of the left coupling element row 12*a* is projected outward from the coupling element attaching portion. In the meantime, the right coupling element row 13*a* is formed in the same way and sewed to the right fastener tape 17. Consequently, the right and left fastener stringers are completed.

Figure 6:
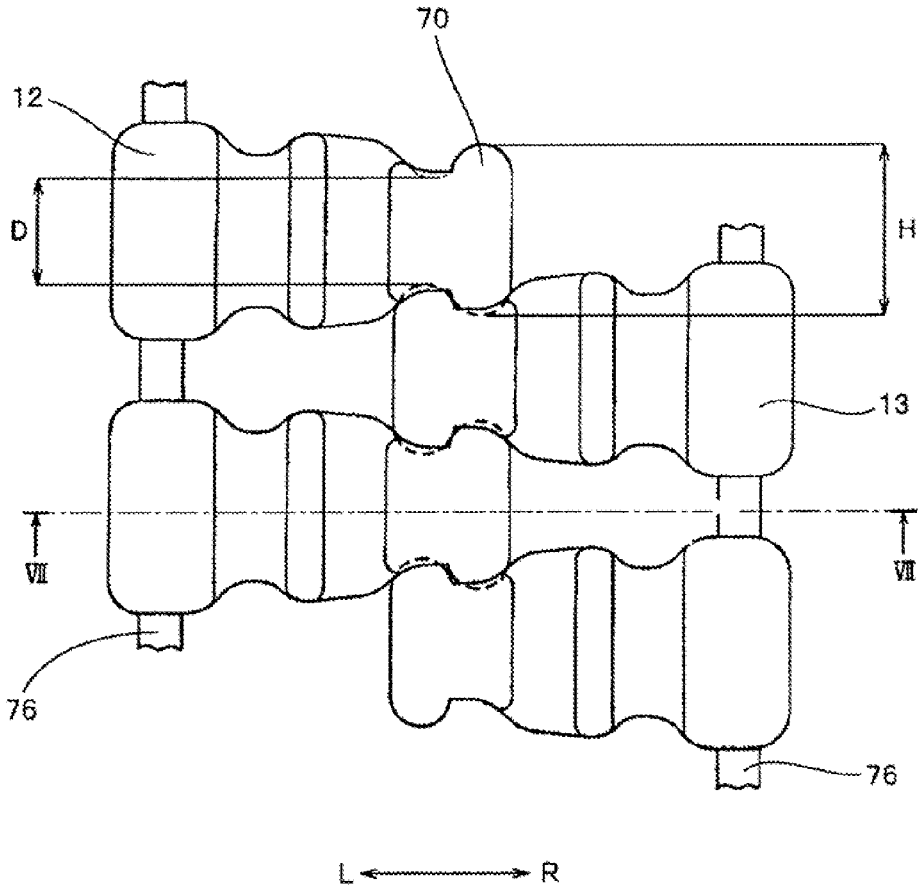
FIG. 6 is a plan view of the coupling element row units showing a state in which left coupling elements and right coupling elements are coupled with one another by pulling up a slider.
Figure 7:
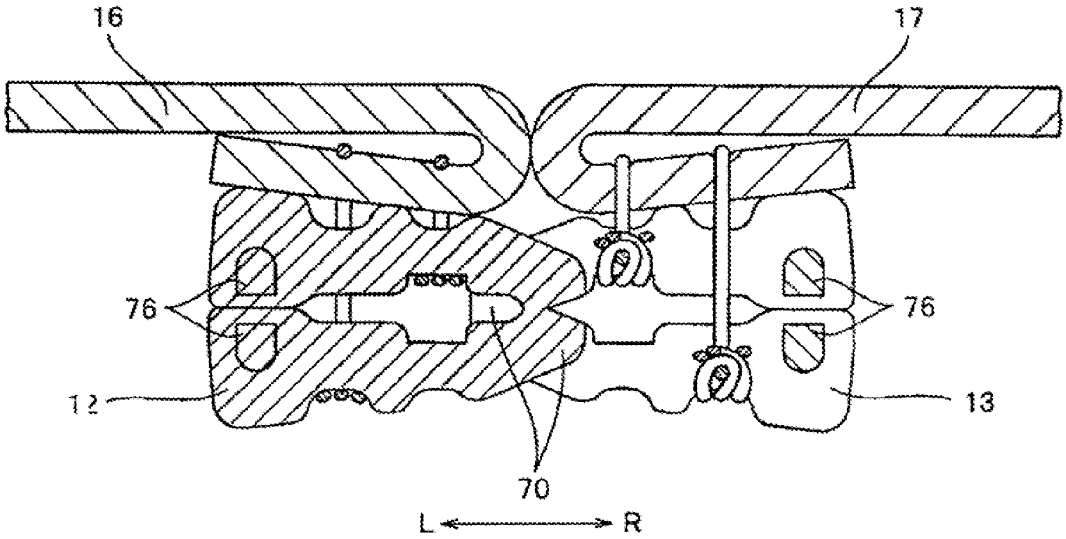
FIG. 7 is a sectional view at right angle to the coupling axis of the slide fastener or a sectional view taken along the line VII-VII in FIG. 6.

FIG. 6 is a plan view of coupling element rows showing a state in which the left coupling elements 12 and the right coupling element 13 are coupled with each other by pulling up a slider 50. FIG. 7 is a sectional view at right angle to the coupling axis of the slide fastener 1 or a sectional view taken along the line VII-VII of FIG. 6.

When the left coupling element 12 and the right coupling element 13 are coupled with each other as shown in FIG. 6, the coupling head 70 having a mountain height H of each of the left coupling element 12 and the right coupling element 13 is located in a gap between the leg portions each having a neck width D of the right coupling element 13 and the left coupling element 12.

Figure 8:
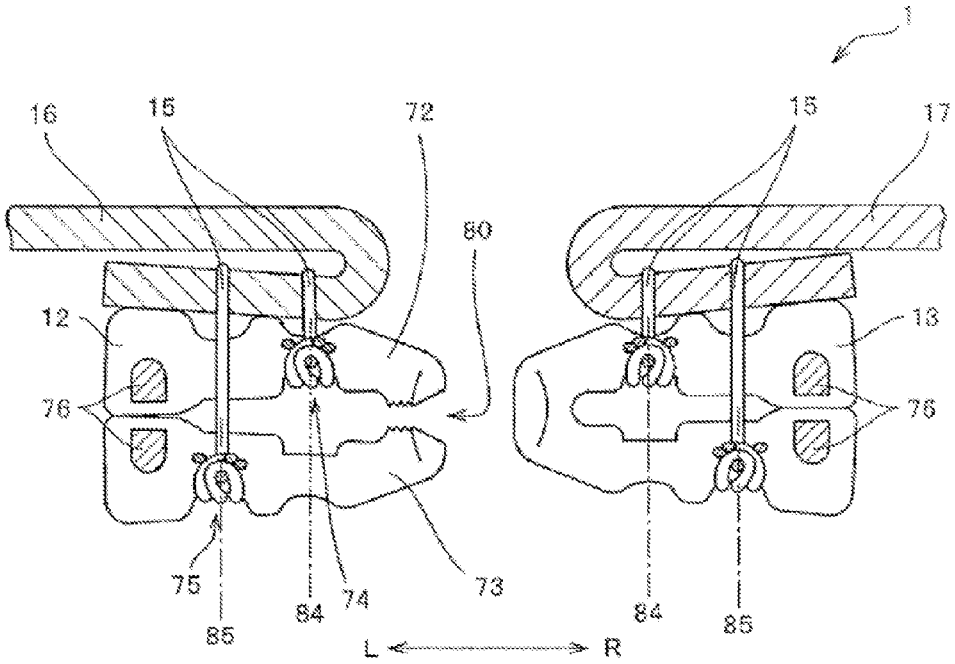
FIG. 8 is a diagram showing a state in which the left coupling elements and the right coupling elements are cleaved from one another in the right and left direction while the left coupling element is broken at its vulnerable portion.

Next, FIG. 8 shows a state in which when an excessive lateral pulling force is applied with the left coupling elements 12 and the right coupling elements 13 coupled with one another as shown in FIG. 7, the left coupling element 12 and the right coupling element 13 are cleaved in the right and left direction so that the left coupling element 12 is broken at the vulnerable portion 80.

In the slide fastener 1 shown in FIG. 7, a difference between the mountain height H and the neck width D of the coupling head 70 of the left coupling element 12 and the right coupling element 13 is set relatively small. Thus, when the slide fastener 1 is cleaved, no lateral pulling force of, for example, 130 N/cm or more is applied. However, if any lateral pulling force is applied while the slide fastener 1 is twisted for some reason or a pushing force and the lateral pulling force are applied to the right and left fastener stringers of the slide fastener 1 at the same time, the coupling elements in a coupling state can be broken.

According to the present invention, the vulnerable portion 80 having the weakened breaking resistance is formed at a single position in the range from the sewing line 84 in the sewing portion 74 of the left coupling element 12 up to the sewing line 85 in the sewing portion 75 via the coupling head 70. Consequently, when the coupling element is broken by the lateral pulling force, breaking occurs at the vulnerable portion 80. Even if the left coupling element 12 is broken at the vulnerable portion 80, an inconvenience that the broken part of the first leg portion 72 side is separated from the left fastener tape 16 can be reduced because the broken part on the first leg portion 72 side is kept sewed to the left fastener tape 16 at the sewing portion 74.

According to the embodiment shown in FIG. 8, even if the sewing thread 15 is broken by a strong lateral pulling force, an inconvenience that the first leg portion 72 is separated from the left fastener tape 16 can be reduced, because the end portion of the first leg portion 72 is connected with the other left coupling element 12 by the connecting thread 76.

On the other hand, because the broken part on the second leg portion 73 side is sewed to the left fastener tape 16 at the sewing portion 75, an inconvenience that the broken part of the second leg portion 73 is separated from the left fastener tape 16 can be reduced. Likewise, even if the sewing thread 15 is broken, an inconvenience that the second leg portion 73 is separated from the left fastener tape 16 can be reduced, because the end portion of the second leg portion 73 is connected to the other left coupling element 12 adjacent with the connecting thread 76.

Figure 9:
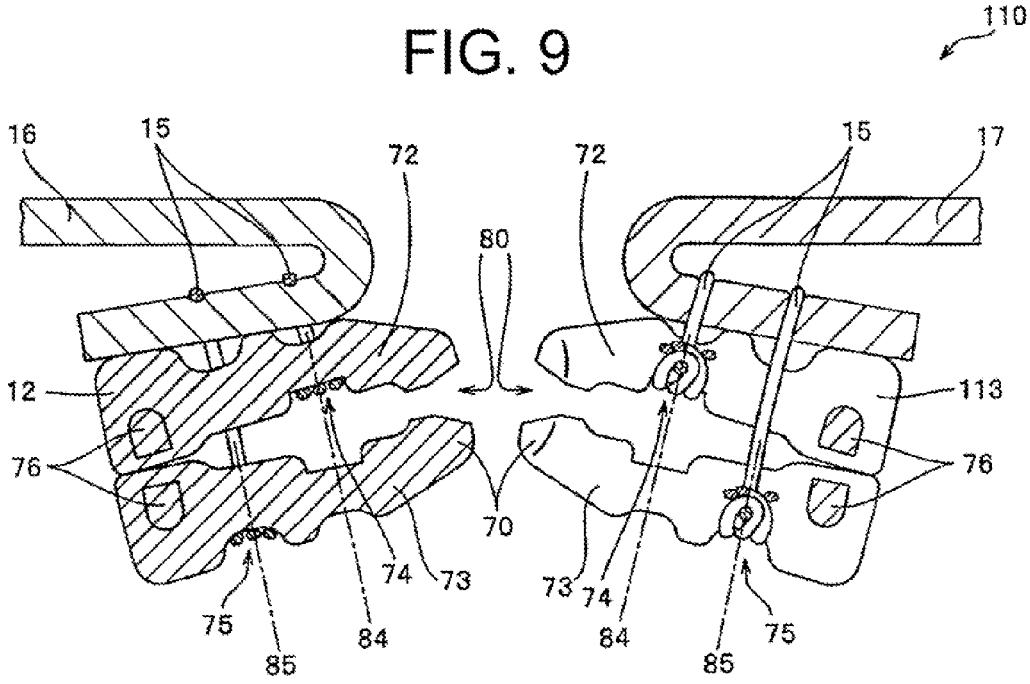
FIG. 9 is a diagram showing an embodiment in which the vulnerable portion having a weakened breaking resistance is formed at a coupling head of both the left coupling element and the right coupling element.

Although in the embodiments shown in FIGS. 2 and 7, the vulnerable portion 80 is formed at only the coupling head 70 of the left coupling element 12 while no vulnerable portion 80 is formed at the coupling head 70 of the right coupling element 13, the vulnerable portions 80 may be formed at both the coupling heads 70 of the left coupling element 12 and the right coupling element 113 of the slide fastener 110 as shown in FIG. 9. Even if an excessive lateral pulling force is applied to the slide fastener 110 so that breaking occurs in the vulnerable portions 80 of both the left coupling element 12 and the right coupling element 113, an inconvenience that the broken part of the left coupling element 12 or the right coupling element 113 is separated from the left fastener tape 16 or the right fastener tape 17 can be reduced because the broken part of the left coupling element 12 or the right coupling element 113 is held by the sewing thread 15 or the connecting thread 76.

Second Embodiment

Next, other embodiment of a vulnerable portion formed in a coupling element will be described with reference to FIG. 10.

Figure 10:
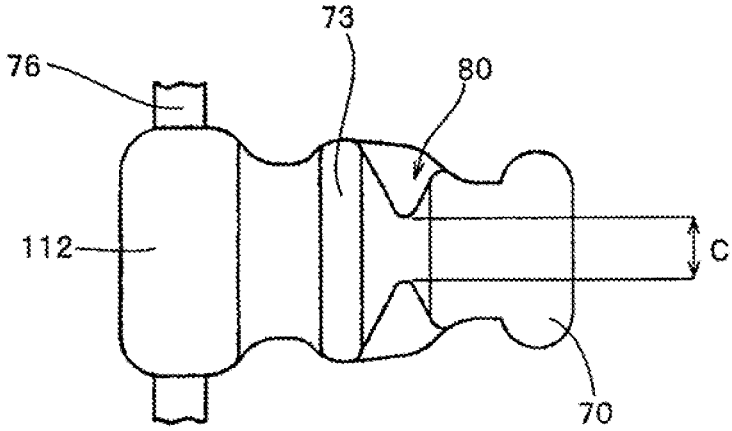
FIG. 10 is a diagram showing an embodiment in which the vulnerable portion having a weakened breaking resistance is formed at a single position of a sewing portion.

FIG. 10 is a diagram showing an embodiment that the vulnerable portion 80 having the weakened breaking resistance and a coupling element width C is formed at a single position of a leg portion around which a sewing thread for sewing a coupling element 112 to a fastener tape strides. At the portion having the coupling element width C, a substantially V shaped cutout extending in the front and rear face direction of the fastener tape is formed in both the side faces of a second leg portion 73 of the coupling element 112, so that its coupling element width is smaller than other portions of the coupling element 112. Consequently, the sectional area of the second leg portion 73 of the coupling element 112 is smaller than other portions and thus, the breaking resistance of the portion having the coupling element width C is reduced as compared with the other portions. Therefore, if the coupling element 112 is broken by a lateral pulling force, the breaking is generated at the vulnerable portion 80.

Even if an excessive lateral pulling force is applied to the coupling element 112 so that breaking occurs, an inconvenience that the broken part of the coupling element 112 is separated from the fastener tape can be reduced, because the broken part of the coupling element 112 is held by the sewing thread (not shown) or the connecting thread 76.

Third Embodiment

Next, other embodiment of a vulnerable portion formed in a coupling element will be described with reference to FIG. 11.

Figure 11:
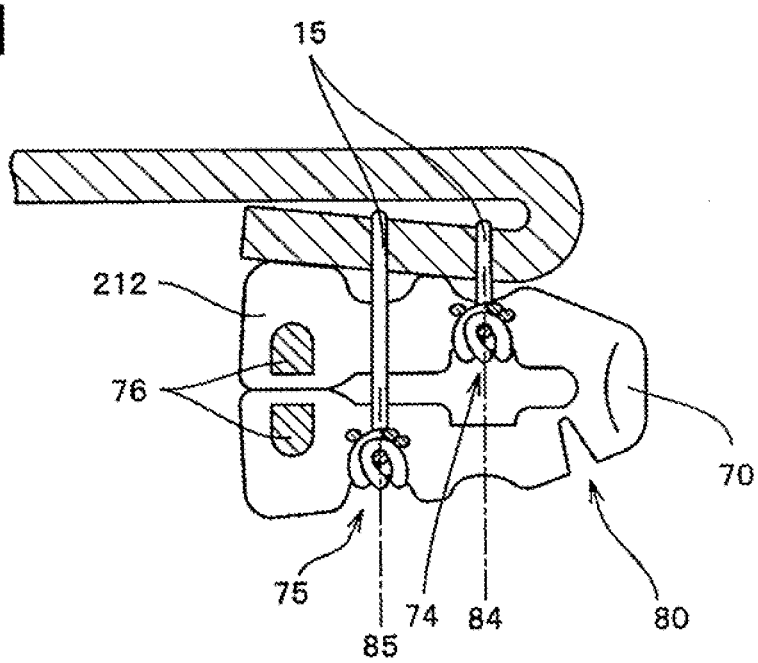
FIG. 11 is a diagram showing an embodiment in which the vulnerable portion having the weakened breaking resistance is formed at a single position in a range from the coupling head to the sewing portion.

FIG. 11 is a diagram showing an embodiment that a vulnerable portion 80 having the weakened breaking resistance is formed at a single position in the range from the coupling head 70 of a coupling element 212 up to a sewing line 85 in a sewing portion 75. The vulnerable portion 80 is formed by digging inward from the outer peripheral face of the coupling element 212 in a range from a sewing line 84 on a leg portion of the coupling element 212 up to the sewing line 85 via the coupling head 70 so that its sectional area is minimized, the substantially V shaped cutout being extended in the length direction of a fastener tape. Consequently, when the coupling element 212 is broken by the lateral pulling force, breaking occurs at the vulnerable portion 80.

Even if an excessive lateral pulling force is applied to the coupling element 212 so that the coupling element 212 is broken at the vulnerable portion 80, an inconvenience that the broken part is separated from the fastener tape can be reduced, because the broken part of the coupling element 212 is held by a sewing thread 15 or a connecting thread 76.

Although according to the embodiment shown in FIG. 11, the vulnerable portion 80 having the weakened breaking resistance is formed at a single position in the range from the coupling head 70 to the sewing line 85 of the sewing portion 75, the object of the present invention can be achieved by forming the vulnerable portion 80 having the weakened breaking resistance at a single position in the range from the sewing lien 84 in a sewing portion 74 of the coupling element 212 up to the coupling head 70.

Fourth Embodiment

Next, other embodiment of a vulnerable portion formed in a coupling element will be described with reference to FIG. 12.

Figure 12:
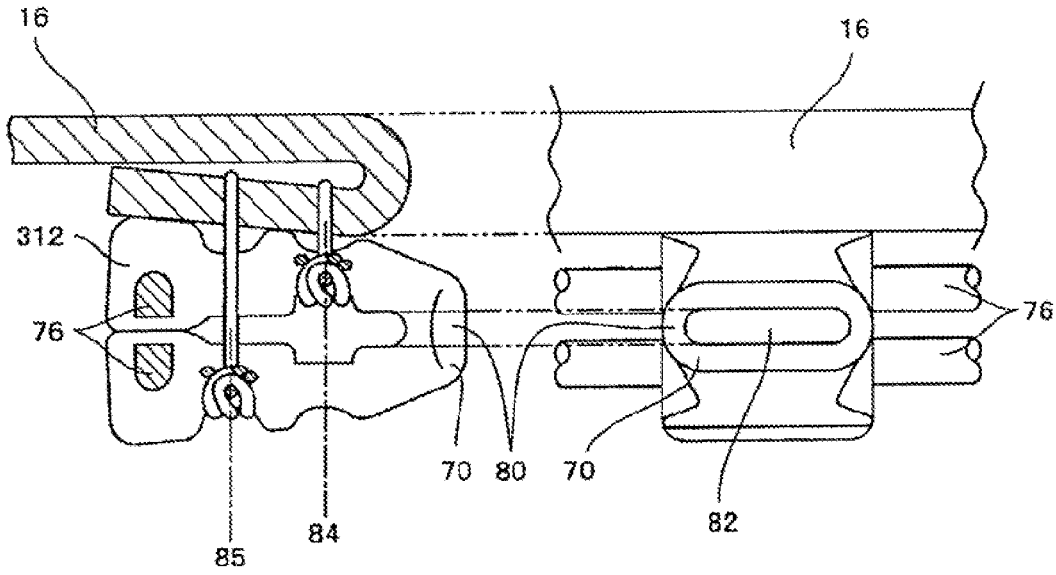
FIG. 12 is a diagram showing an embodiment in which the vulnerable portion having the weakened breaking resistance is formed on both sides of an opening of the coupling head.

FIG. 12 is a diagram showing an embodiment that an opening 82 is formed in a coupling head 70 of a coupling element 312, and the vulnerable portions 80 are formed on the both side portions of the opening 82. The vulnerable portions 80 are formed vertically on the both side portions of the opening 82 such that the sectional area is minimized in the range from a sewing line 84 on a leg portion of the coupling element 312 up to a sewing line 85 via the coupling head 70. Thus, when the coupling element 312 is broken by a lateral pulling force, breaking occurs in the vulnerable portions 80 provided vertically on the both sides of the opening 82.

Even if the coupling element 312 is broken at the vulnerable portions 80 when an excessive lateral pulling force is applied to the coupling element 312, the broken part of the coupling element 312 is held by a sewing thread 15 or a connecting thread 76. Consequently, an inconvenience that the broken part is separated from the fastener tape can be reduced.

Fifth Embodiment

Next, other embodiment of a vulnerable portion formed in a coupling element will be described with reference to FIG. 13.

Although in the above-described respective embodiments, the embodiment that the vulnerable portion is formed at a single position of a coupling element of a concealing type slide fastener having an excellent concealing performance has been described, the present invention is not limited to the concealing type slide fastener but may be applied to a planar slide fastener in which the edge of the fastener stringer is not bent to a U shape. FIG. 13 is a view showing a state in which a coupling element 512 formed by injection molding is sewed to a coupling element attaching portion of a fastener tape 516 by bending into the U shape or a sectional view at right angle to the coupling axis line of the slide fastener.

Figure 13:
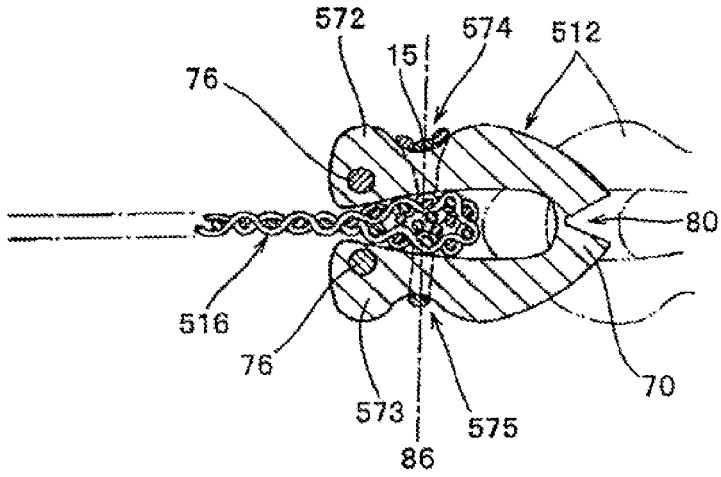
FIG. 13 is a diagram showing an embodiment in which the coupling element having the vulnerable portion according to the present invention is sewed to a coupling element attaching portion on a fastener tape side edge portion such that the coupling element is curved into a U shape.

As for the slide fastener shown in FIG. 13, after the coupling element 512 formed by injection molding is bent to the U shape so as to sandwich the coupling element attaching portion on the side edge portion of the fastener tape 516, the slide fastener is sewed to the fastener tape 516 such that a sewing thread 15 strides around a sewing portion 574 of a first leg portion 572 and a sewing portion 575 of a second leg portion 573. Consequently, a coupling head 70 of the coupling element 512 is projected outward from the coupling element attaching portion of the fastener tape 516.

The vulnerable portion 80 having the weakened breaking resistance is formed in the coupling head 70 of the coupling element 512. The vulnerable portion 80 is formed by digging the coupling head 70 from outside toward the edge of the fastener tape 516 such that its sectional area is minimized in the range from a sewing line 86 on the first leg portion 572 of the coupling element 512 up to a sewing line 86 on the second leg portion 573 via the coupling head 70, the vulnerable portion 80 being formed as a substantially V-shaped cutout extending along the length direction of the fastener tape 516. Thus, when the coupling element 512 is broken by the lateral pulling force, the bottom portion of the V-shaped vulnerable portion 80 is broken. Even if an excessive lateral pulling force is applied to the coupling element 512 so that braking occurs in the vulnerable portion 80, an inconvenience that a broken part is separated from the fastener tape can be reduced, because the broken part of the coupling element 512 is held by the sewing thread 15 or a connecting thread 76.

Sixth Embodiment

Next, other embodiment of a vulnerable portion formed in a coupling element will be described with reference to FIG. 14.

Although in the above-described respective embodiments, an embodiment of a slide fastener that the vulnerable portion is formed in part of a coupling element formed by injection molding has been described, the present invention may be applied to the zigzag-like or coil-like continuous coupling element (monofilament made of synthetic resin). FIG. 14 is a perspective view of a zigzag-like coupling element 412 in which the vulnerable portions 80 are formed in part thereof.

Figure 14:
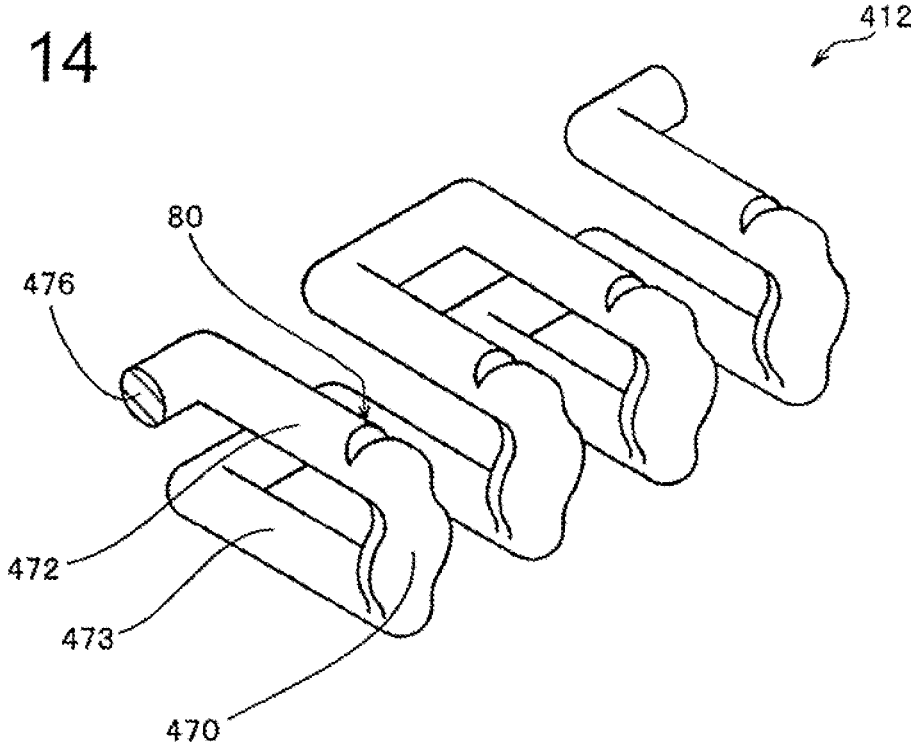
FIG. 14 is a view showing an embodiment in which the vulnerable portions having the weakened breaking resistance are formed on part of zigzag-like coupling elements.

As shown in FIG. 14, a coupling head 470 is formed on a side edge of the zigzag-like coupling element 412. A first leg portion 472 and a second leg portion 473 are forked and extended from the both ends of a coupling head 470. When the zigzag-like coupling elements 412 are sewed to a fastener tape, a core thread (not shown) is passed through the central portion in the zigzag-like coupling element 412 and then, the coupling elements are sewed with a sewing thread (not shown) such that a sewing thread strides around a sewing portion of the first leg portion 472 and a sewing portion of the second leg portion 473. In the meantime, the first leg portion 472 and the second leg portion 473 of each coupling element are connected to the first leg portion 472 and the second leg portion 473 of an adjacent coupling element via a reversal connecting portion 476. The sewing portion of the first leg portion 472 and the sewing portion of the second leg portion 473 are not formed into a concave groove preliminarily but portions defined after the coupling element is sewed. Further, the straight sewing line for connecting the both sewing portions and at right angle to the fastener tape is defined after the coupling element 412 is sewed to the fastener tape.

The vulnerable portions 80 having the weakened breaking resistance are formed in part of the first leg portions 472 of the zigzag-like coupling element 412 by reducing the sectional area. The vulnerable portion 80 is a groove formed by cutting the slide fastener along the length direction into a substantially V shape or by melting processing using a heater or ultrasonic after the coupling elements 412 are molded of monofilament of synthetic resin.

The vulnerable portions 80 are formed by cutting part of a portion on the side of the coupling head 470 side with respect to the sewing portion of the zigzag-like coupling element 412. Consequently, even if an excessive lateral pulling force is applied to the coupling element 412 so that the coupling element 412 is broken at the vulnerable portion 80, an inconvenience that a broken part is separated from the fastener tape can be reduced, because the broken part of the coupling element 412 is held by the sewing thread or the reversal connecting portion 476.

Seventh Embodiment

Next, other embodiment of a vulnerable portion formed in a coupling element will be described with reference to FIG. 15.

Figure 15:
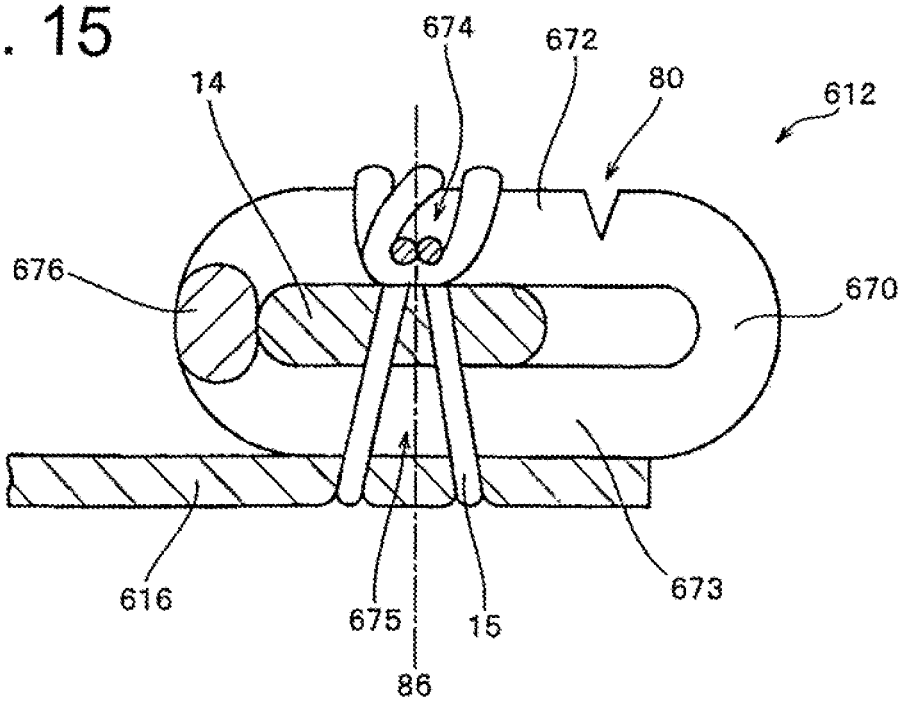
FIG. 15 is a diagram showing an embodiment in which the vulnerable portion having the weakened breaking resistance is formed on part of a coil-like coupling element.

FIG. 15 is a view showing a state in which a coil-like coupling element 612 is sewed to a coupling element attaching portion of a fastener tape 616 or a sectional view at right angle to the coupling axis line of a slide fastener.

As shown in FIG. 15, a coupling head 670 is formed on a side edge of the coil-like coupling element 612. A first leg portion 672 and a second leg portion 673 are forked and extended from both ends of the coupling head 670. When the coil-like coupling elements 612 are sewed to the fastener tape 616, a core thread 14 is passed through the central portion in the coil-like coupling elements 612 and then, the coupling elements are sewed with a sewing thread 15 such that the sewing thread 15 strides around a sewing portion 674 of the first leg portion 672. At this time, a sewing portion 675 of the second leg portion 673 is placed on the side of the fastener tape 616 of the first leg portion 672 and with the sewing thread 15 striding around only the first leg portion 672, the sewing portion 675 of the second leg portion 673 is pressed against the fastener tape 616 via the core thread 14, so that the first leg portion 672 and the second leg portion 673 are sewed to the fastener tape 616. In the meantime, the first leg portion 672 and the second leg portion 673 of each coupling element are connected to the second leg portion 673 and the first leg portion 672 of an adjacent coupling element via a reversal connecting portion 676. A straight line for connecting the sewing portion 674 with the sewing portion 675 and at right angle to the fastener tape 616 is defined as a sewing line 86.

The vulnerable portion 80 whose breaking resistance is weakened by reducing its sectional area is formed at a single position in the range (that is, a portion on the side of the coupling head 670 with respect to the sewing line 86) from the sewing portion 674 of the first leg portion 672 in the coil-like coupling element 612 to the sewing portion 675 of the second leg portion 673 via the coupling head 670. The vulnerable portion 80 is formed by cutting in the length direction of the slide fastener into a substantially V shape using a cutter or by melting processing using a heater or ultrasonic after the coupling elements 612 are formed of monofilament of synthetic resin.

By forming the vulnerable portion 80 in the coil-like coupling element 612, even if an excessive lateral pulling force is applied to the coupling element 612 so that the coupling element 612 is broken at the vulnerable portion 80, an inconvenience that a broken part is separated from the fastener tape 616 can be reduced, because the broken part of the coupling element 612 is held by the reversal connecting portion 676.

INDUSTRIAL APPLICABILITY

The slide fastener according to the present invention can not only be used at an opening for airbag expansion but also can be used at the opening of a life jacket expansion which is to be expanded with expansion gas.

The invention claimed is:

1. A slide fastener comprising:

a pair of right and left fastener tapes and coupling elements which are attached to plural positions along right and left coupling element attaching portions which are side edge portions of the fastener tapes opposing each other, wherein opposing coupling element rows are capable of being coupled and separated, each of the coupling elements includes a coupling head which engages with an opposing coupling element, the coupling head includes a vulnerable portion in a central portion thereof, whose breaking resistance is weakened, first and second leg portions are continuously disposed on end portions of the coupling head in a direction extending away from the coupling head, the first leg portions and the second leg portions are sewn to the fastener tapes via a sewing portion, the vulnerable portion includes a cut-out portion located on an outer face of the coupling head, and the sewing portion comprises a first sewing portion at a first position located on an inner face of the first leg portion between the coupling head and an end of the first leg portion and a second sewing portion at a second position located on an outer face of the second leg portion between the coupling head and an end of the second leg portion.

2. The slide fastener according to claim 1, wherein the side edge portions of the fastener tapes to which the coupling elements are attached have a U-shaped section which is bent inward, and the coupling heads of the coupling elements are attached so as to be projected outward from a bent end of the U-shaped section.

3. The slide fastener according to claim 1, wherein the first leg portions of adjacent-coupling elements are connected to each other by a connecting thread and the second leg portions of the adjacent coupling elements are connected to each other by another connecting thread.

4. The slide fastener according to claim 1, wherein the cut-out portion is V-shaped.

* * * * *

UNITED STATES PATENT AND TRADEMARK OFFICE

CERTIFICATE OF CORRECTION

PATENT NO. : 8,572,816 B2
APPLICATION NO. : 12/811603
DATED : November 5, 2013
INVENTOR(S) : Kenji Dono et al.

It is certified that error appears in the above-identified patent and that said Letters Patent is hereby corrected as shown below:

On the title page, item (57), under "ABSTRACT", in column 2, line 6, Delete "V" and insert -- V shape --, therefor.

In the Specification

In column 8, line 17, Delete "sewing'thread" and insert -- sewing thread --, therefor.

Signed and Sealed this
Twenty-fifth Day of February, 2014

Michelle K. Lee

Michelle K. Lee
*Deputy Director of the United States Patent and Trademark Office*